United States Patent [19]

Zink

[11] 4,220,831

[45] Sep. 2, 1980

[54] INTRUSION SENSING DEVICE

[76] Inventor: Henry R. Zink, P.O. Box 459, Lake Arrowhead, Calif. 92352

[21] Appl. No.: 925,279

[22] Filed: Jul. 17, 1978

[51] Int. Cl.[2] ..... H04R 17/00; G08B 13/00

[52] U.S. Cl. ..... 179/110 A; 181/160; 340/545

[58] Field of Search ..... 179/110 A; 181/160, 181/175, 176; 310/324, 322; 340/541, 545, 558; 307/129, 10 AT

[56] References Cited

U.S. PATENT DOCUMENTS

| | | | |
|---|---|---|---|
| 1,715,831 | 6/1929 | Hahnemann | 181/160 |
| 3,331,970 | 7/1967 | Dundon et al. | 310/324 |
| 3,754,208 | 8/1973 | Eilers | 181/176 X |
| 3,970,879 | 7/1976 | Kumon | 179/110 A X |

FOREIGN PATENT DOCUMENTS

| | | | |
|---|---|---|---|
| 529444 | 9/1956 | Fed. Rep. of Germany | 181/160 |
| 2723745 | 12/1978 | Fed. Rep. of Germany | 340/558 |

*Primary Examiner*—Thomas W. Brown

*Attorney, Agent, or Firm*—John H. Crowe; Fred N. Schwend

[57] ABSTRACT

An intrusion sensing device includes a sound frequency discriminating micophone having a diaphragm coupled to the atmosphere through a closed end resonating chamber having a length equal to one quarter the median wavelength of a relatively narrow band of sound frequencies peculiar to the act of intrusion into a building or the like. The diaphragm has a layer of piezoelectic material bonded thereto for generating an alarm signal only when sounds within such narrow band of frequencies are received within the resonating chamber. A linear amplifier connected to the microphone has an extremely low current drain, permitting continuous operation of the device while using small, low power batteries.

9 Claims, 7 Drawing Figures

INTRUSION SENSING DEVICE

BACKGROUND OF THE INVENTION

1. Field of the Invention

This invention relates to sound frequency sensing systems and has particular reference to a system for sensing a very narrow band of sound frequencies, such as are produced during the initial stages of entry or breaking into a building, automobile or the like.

2. Description of the Prior Art

It is known that certain characteristic sounds are normally created in the initial stages of entering a building or dwelling. For example, a metal-to-metal sound having a particular frequency or band of frequencies is created in turning a door knob or removing a lock bolt from its strike plate; a metal-to-glass sound of a similar frequency is created when glass is cut by a metal cutter; a glass-to-glass sound, also of a similar frequency, is created when a glass pane is broken or slid over a similar pane. Also, breaking or snapping of wood creates a sound of similar frequency. These "intrusion profile" sound frequencies all fall within a very narrow band of frequencies.

Ideally, if such special intrusion frequencies could be sensed and if a discrimination could be made against other normal sounds or vibrations such as a knock on the door or noise from a passing vehicle, an intrusion alarm system could be activated before an intruder could actually gain entrance to the building in contradistinction to those present alarm systems which are activated only after the intruder has already entered.

Attempts have been made heretofore to sense such aforementioned narrow band frequencies for the purpose of activating an alarm when an unauthorized person attempts to enter a building, automobile, etc. Such prior sensing devices generally comprise a broad band sensitive microphone whose output is passed through one or more electronic frequency discriminating amplifiers or the like for the purpose of producing an alarm signal only when such intrusion profile frequencies are sensed. However, such electronic devices of which I am aware, are relatively costly and complicated and are not generally capable of sensing only such narrow band of frequencies and discriminating against other non-related sounds, such as the sound of a passing motorcycle, truck, siren or rattling of a window due to wind. Thus, such devices are prone to setting off false alarms. Additionally, such electronic devices generally draw a significant amount of current, requiring frequent replacement of batteries in the case of a battery operated device.

SUMMARY OF THE INVENTION

A principal object of the present invention is to provide a sound frequency sensing device which is capable of sensing sounds within a very narrow frequency range and discriminating against all others.

Another object is to provide a microphone capable of picking up a narrow band of sound frequencies only.

A further object is to provide a microphone which will resonate at a fixed frequency in response to sounds within a somewhat broader band of frequencies.

Another object is to provide a simple and inexpensive microphone capable of providing a signal in response to typical intrusion signals.

According to my invention, a sound frequency discriminating microphone is provided which is highly sensitive to a specific narrow band of sound frequencies only. A sound responsive metal diaphragm having a thin layer of piezoelectric material bonded to one side thereof is mounted at the end of a resonant chamber having a length equal to one quarter the median wavelength of the intrusion band of sound frequencies it is desired to sense.

In order to provide a highly effective coupling between the air within the chamber, which has a relatively low acoustic impedance, and the diaphragm, which has a relatively high acoustic impedance, the diaphragm is supported to flex about its node and the portion thereof extending beyond such node is arranged to flex within an air loading chamber communicating with the central portion of the diaphragm to reduce the acoustic impedance of the diaphragm to more closely approach the impedance of the air and thus improve the air-to-diaphragm coupling effect.

The end of the resonate chamber opposite the diaphragm is closed by a non-vibratile plate, enabling a standing sound wave of substantially the aforementioned median frequency to be set up in the resonant chamber and to substantially exclude all others.

Openings are formed in the side of the resonant chamber adjacent the plate to admit sound waves into the chamber. This construction causes the diaphragm to flex within a very narrow frequency range in response to reception of sound waves within the resonant chamber of the aforementioned somewhat broader band of frequencies. Thus, no frequency discriminating electronic amplifier or the like is required in order to provide an intrusion signal.

BRIEF DESCRIPTION OF THE DRAWINGS

The manner in which the above and other objects of the invention are accomplished will be readily understood on reference to the following specification when read in conjunction with the accompanying drawing, wherein.

DESCRIPTION OF THE PREFERRED EMBODIMENT

Figure 1:
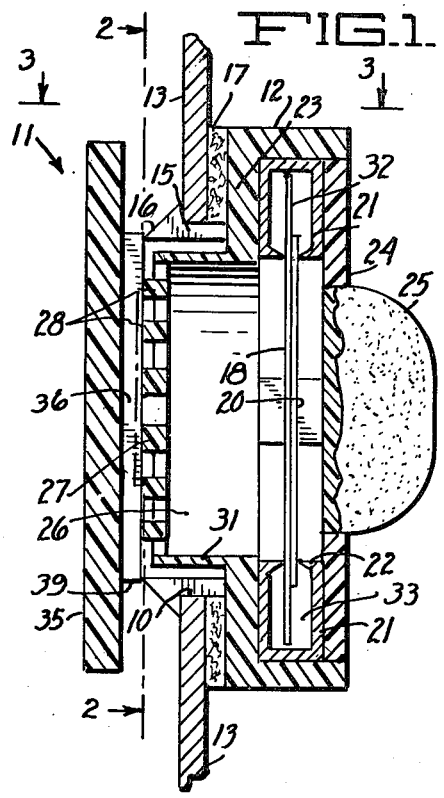
FIG. 1 is a longitudinal sectional view through a sound frequency discriminating microphone embodying a preferred form of the present invention, certain portions being shown in full.

While my invention is susceptible to many different forms, there is shown in the drawing and will be described in detail, one specific embodiment with the understanding that the present disclosure is to be considered as an exemplification of the principles of the invention and is not intended to limit the invention to the embodiment illustrated.

Figure 2:
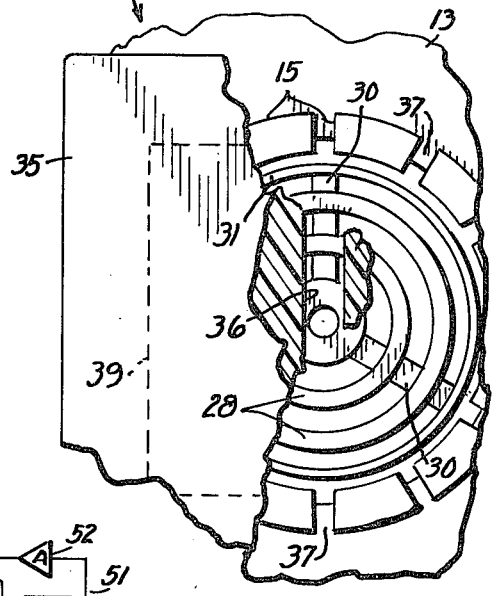
FIG. 2 is a transverse sectional view taken substantially along the line 2—2 of FIG. 1, with certain portions shown in full lines and other portions shown in cross-section.
Figure 3:
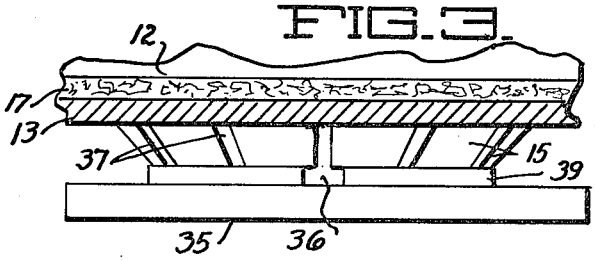
FIG. 3 is a top plan view with parts broken away and is taken along line 3—3 of FIG. 1.
Figure 4:
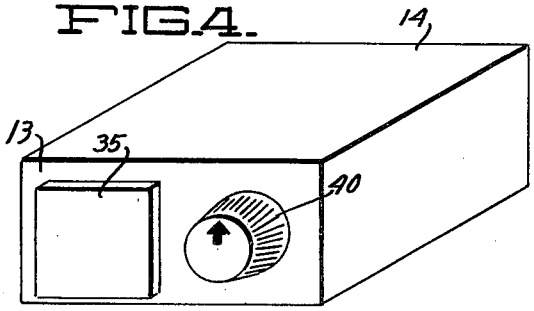
FIG. 4 is a perspective view of the device embodying the above noted microphone.

Referring particularly to FIGS. 1, 2 and 3, the microphone is generally indicated at 11 and comprises an annular housing 12, preferably of plastic, which is fitted within an opening 10 in the wall 13 of a suitable box-type casing 14. For this purpose, a ring of flexible segment leaves 15 are formed integral with the housing with barbed tips 16 enabling the same to be snapped into locking engagement with the wall 13. A layer of felt or the like is interposed between the wall 13 and an annular wall 23 of the housing 12 to hold the microphone in place.

A thin metal disc-like diaphragm 18 is provided having a disc-like layer 20 of a piezoelectric material, such as barium titanate, suitably bonded to one side thereof, the layer 20 having a thickness substantially the same as the thickness of diaphragm 18.

Figure 7:
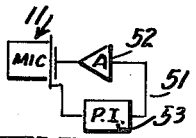
FIG. 7 is a schematic electrical diagram of the coupling circuit for the microphone.

It will be noted that the layer 20 is smaller in diameter than the diaphragm 18 and is located concentrically thereof. Metal clips 21 are spaced around the diaphragm. Such clips terminate in jaws 22 which grip the diaphragm 18 and layer 20 at a node circle adjacent the periphery of the layer 20 to form flexure supports about which the diaphragm and layer 20 may flex in response to the impingement of sound waves thereagainst. The clips 21 are held in place against the wall 23 of the housing 12 by an annular disc 24 suitably secured within the right hand end of the housing. Disc 24 also supports a suitable coupling circuit within a potted assembly 25. Such circuit may take the form generally shown in FIG. 7 in which a feed-back loop 51, including an amplifier 52 and phase inverter 53, is connected in circuit with the diaphragm unit to aid in reinforcing the critical frequency of response of the microphone.

The diaphragm 18 is located at one end of a resonant chamber or cavity 26 having a length substantially equal to one quarter of the median wavelength of the narrow band of profile frequencies which it is desired to sense. The opposite end of the chamber 26 is covered by a diffusion grille 27 formed by concentric rings 28 integral with radial bars 30 which extend inwardly from a barrel portion 31 of the housing 12 to support the rings 28.

The peripheral portion 32 of the diaphragm 18 which extends radially outward from the node and jaws 22 of clips 21, flexes within an annular loading chamber 33 located on opposite sides of the diaphragm and communicating with the opposite sides of the central portion of the diaphragm and layer 20. As the diaphragm is bowed by a sound wave front, the outer portion 32 thereof will form a continuation of such bowed contour, compressing the air within one side of the chamber 33. This enables the pressure applied against the central portion of the diaphragm to be reinforced by the pressure exerted within the chamber 33. Thus, it effectively loads the diaphragm to reduce the acoustical impedance thereof and results in a more effective coupling with the air column within the resonant chamber 26. Now, as the diaphragm is bowed in the opposite direction by a rarefaction of the sound wave front, the outer portion 32 thereof will be flexed in the opposite direction to compress the air within the opposite side of the loading chamber 33.

The aforementioned part of the microphone 11 and coupling circuit therefor are similar to the construction of a sound producing device disclosed in the U.S. Pat. No. 3,277,405, issued to B. M. Potter on Oct. 4, 1966, and U.S. Pat. No. 3,331,970, issued to T. M. Dundon et al on July 18, 1967, both incorporated herein by reference. Such sound producing device and combined coupling circuit are commercially available under the trade name "SONALERT", Model SNP 428.

According to the present invention, a non-vibratile plate 35, preferably of plastic, is suitably bonded to the rings 28 of the air diffuser grille 27 to close the left hand end of the chamber 26 to enable the formation of a standing wave against the diaphragm 18. A diametrically extending groove 36 is formed in a portion 39 of the plate, such portion having a periphery substantially the same size as the diameter of the barrel portion 31 defining the resonance chamber 26. The groove 36 extends across the outer end of the chamber 26 to permit entrance of sound waves thereinto. Also, as noted in FIGS. 2 and 3, the segment leaves 15 are separated from each other somewhat to form slots 37 through which the sound waves may also pass around the barrel portion 31 without interfering with the standing wave formed in the chamber 26.

It will be noted that the plate 35 extends materially beyond the diameter of the chamber 26, i.e., it has a greater area than the cross sectional area of the chamber 26, and is also spaced outwardly from the wall 13 to enable a certain amount of reflection of the sound waves as they pass between the plate and wall 13.

In a typical successfully operable embodiment wherein the plate 35 measures $1\frac{1}{2}$ inches square and is spaced approximately $\frac{1}{8}$ inch from the wall 13 and wherein the chamber 26 is 1 inch in diameter, it was found to contribute a gain in sound sensitivity of 16 decibels. Also, the plate 35 provides an improvement in sound fidelity and consequent coupling between the diaphragm and the vibrating air column within the resonating chamber 26 by eliminating any "harshness" or "tininess" due to harmonics of the fundamental standing wave.

Figure 5:
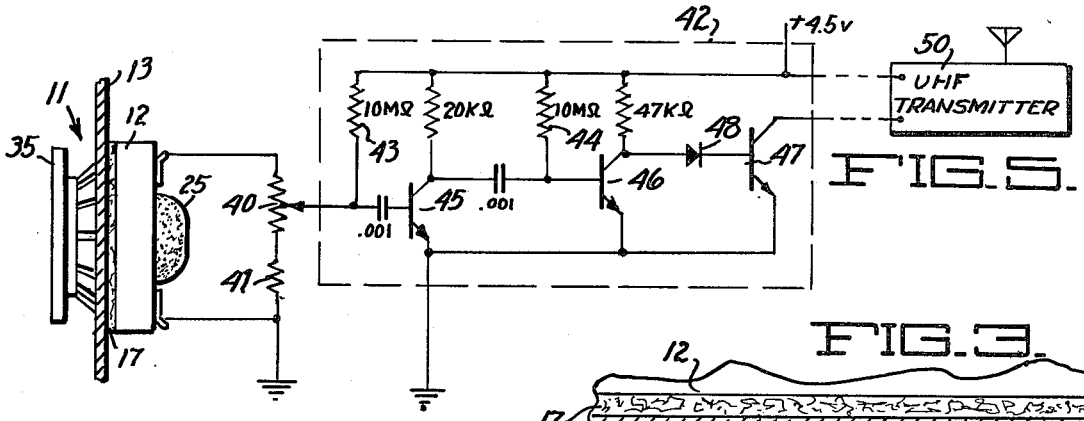
FIG. 5 is a schematic electrical diagram illustrating the microphone associated with an amplifier and alarm signal transmitter.

Referring to FIG. 5, the electrical output of the microphone, established by a generation of voltage across the diaphragm 18 and layer 20, is connected through the aforenoted coupling circuit contained in potted assembly 25 and across a potentiometer 40. The lower end of the potentiometer is connected through a resistor 41 to ground. The movable element of the potentiometer 40 is connected to the input of a capacitor coupled three-stage linear amplifier, generally indicated at 42.

It will be noted that the supply voltage is preferably on the order of $4\frac{1}{2}$ volts and since the bias resistors 43 and 44 for the transistors 45 and 46, respectively, have a value of 10 megohms each, the current drain is very minute, permitting the device to be continuously operated by small batteries over a long period of time.

Transistor 47 forms a switch controlled by a signal passed by diode 48 from the collector of transistor 46 to actuate a suitable alarm device such as a UHF radio transmitter 50.

Figure 6:
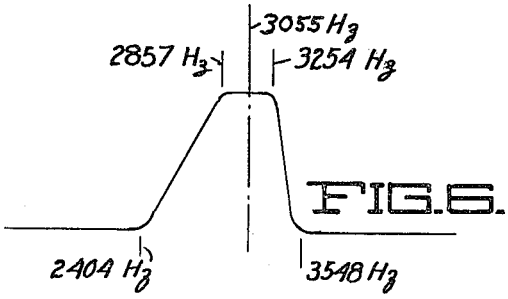
FIG. 6 illustrates a typical band of intrusion frequencies sensed by the microphone.

FIG. 6 illustrates a typical band of intrusion sound frequencies accepted by the microphone. It will be noted that the sound frequencies, ranging from 2404 Hz to 3548 Hz, will be admitted into the resonating chamber 26. However, the standing wave within the resonating chamber will resonate within the narrower band from 2857 Hz to 3254 Hz with a median frequency of approximately 3055 Hz and the diaphragm unit will follow. Accordingly, the microphone will produce a relatively sharply peaked output within the bandwidth of 2857 Hz to 3254 Hz. Thus, the wider band of frequencies, i.e. from 2404 Hz to 3548 Hz, serves to reinforce the standing wave to increase the intensity of vibration of the diaphragm unit.

The microphone, including plate 35, may also be utilized as a sound reproducer, in which case the plate 35 increases the sound intensity and reduces to a minimum any harshness or tininess by substantially eliminating harmonics, leaving only a standing fundamental sound wave in the resonating chamber. When operating the aforementioned actual embodiment with plate 35 incorporated therewith, as a sound reproducer, it was found that the sound intensity was increased by 16 decibels, and that substantially a pure fundamental tone was generated with no noticeable harshness or tininess.

I claim:

1. An intrusion-sensing apparatus for sensing a narrow band of intrusion sound frequencies and excluding others and for signaling the occurrence of said sound frequencies comprising;

a thin metallic diaphragm, a piezoelectric element integral with one side of said diaphragm, said diaphragm and said element forming a vibratile unit for vibrating in response to sound waves impinging thereon, means forming a tubular resonating chamber for coupling said diaphragm to the ambient air, said resonating chamber having a length substantially one quarter of the median wave length of said band of frequencies, and a signalling device for producing signals in response to vibration of said unit.

2. An apparatus as defined in claim 1 wherein said diaphragm forms one end of said resonating chamber, plate means extending across the opposite end of said chamber, and means forming an opening in the side of said chamber adjacent said closing means whereby to communicate the interior of said resonating chamber with the ambient air.

3. Apparatus as defined in claim 1 wherein said diaphragm forms one end of said resonating chamber, plate means extending across the opposite end of said chamber, and means forming a plurality of spaced openings around the side of said chamber adjacent said closing means for communicating the interior of said chamber with the ambient air.

4. Apparatus as defined in claim 1 wherein said diaphragm has a central portion and a peripheral portion, said element substantially covering said central portion only, and means forming an acoustical loading chamber for said peripheral portion, said loading chamber communicating with said central portion whereby to lower the acoustic impedance of said unit.

5. Apparatus as defined in claim 4 wherein said acoustical loading chamber extends on opposite sides of said peripheral portion.

6. Apparatus as defined in claim 5 comprising means for supporting said unit for flexure about a node substantially coincident with the juncture of said central portion and said peripheral portion.

7. Apparatus as defined in claim 1 wherein said signalling device comprises an electric amplifier connected in circuit with said diaphragm and said element.

8. Apparatus as defined in claim 2 wherein said closing plate means comprises a plate member having an area substantially greater than the cross-sectional area of said resonating chamber.

9. Apparatus as defined in claim 1 comprising:

a housing for said vibratile unit and said resonating chamber, a casing having an opening therein, means securing said housing in said opening, said diaphragm forming one end of said resonating chamber, a plate member extending across the opposite end of said resonating chamber, said plate member being exterior of said casing and spaced outwardly from said casing, said plate member having an area substantially greater than the cross-sectional area of said resonating chamber, and means forming at least one opening in said housing intermediate said casing and said plate member for communicating the interior of said resonating chamber with the ambient air.

* * * * *